United States Patent [19]

de Tuya Casuso

[11] 4,234,415

[45] Nov. 18, 1980

[54] APPARATUS FOR SEPARATING SOLIDS

[76] Inventor: Enrique de Tuya Casuso, Juan de Badajoz, 11-2°, IZQ, Leon, Spain

[21] Appl. No.: 11,638

[22] Filed: Feb. 12, 1979

[51] Int. Cl.[3] ..... B03B 5/42

[52] U.S. Cl. ..... 209/172.5; 209/497

[58] Field of Search ..... 209/172–173, 209/44, 445, 451, 452, 497–499

[56] References Cited

U.S. PATENT DOCUMENTS

| | | | |
|---|---|---|---|
| Re. 16,674 | 7/1927 | Chance | 209/172.5 |
| 1,559,938 | 11/1925 | Chance | 209/172.5 |
| 2,516,962 | 8/1950 | Davis | 209/173 |
| 2,624,461 | 1/1953 | Falconer | 209/173 |
| 2,696,300 | 12/1954 | Maust | 209/172.5 |
| 2,700,466 | 1/1955 | Logue et al. | 209/172 |
| 2,760,633 | 8/1956 | Davis | 209/172.5 |
| 2,795,331 | 6/1957 | Dovy | 209/172.5 |
| 2,798,606 | 7/1957 | Dru | 209/173 |
| 2,843,266 | 7/1958 | Matthews | 209/173 |
| 2,889,043 | 6/1959 | Dru | 209/172.5 |
| 3,011,637 | 12/1961 | Felsch et al. | 209/172.5 |
| 3,019,900 | 2/1962 | Lagrost | 209/172 |
| 3,101,312 | 8/1963 | Brinkmann | 209/172 |
| 3,807,558 | 4/1974 | Hamm | 209/497 X |
| 4,055,487 | 10/1977 | Moori | 209/452 X |

FOREIGN PATENT DOCUMENTS

| | | | |
|---|---|---|---|
| 547620 | 10/1957 | Canada . | |
| 1141248 | 8/1957 | France | 209/172.5 |
| 1355641 | 2/1964 | France . | |
| 288588 | 6/1963 | Spain . | |
| 303278 | 9/1964 | Spain . | |
| 308886 | 3/1965 | Spain . | |
| 309116 | 4/1965 | Spain . | |
| 155765 | 12/1961 | U.S.S.R. | 209/173 |

OTHER PUBLICATIONS

"Separador Conico-Helicoidal", Sales Brochure of Tuya of Leon, Spain.

*Primary Examiner*—Ralph J. Hill

*Attorney, Agent, or Firm*—Finnegan, Henderson, Farabow, Garrett & Dunner

[57] ABSTRACT

Improved apparatus for separating mixed solids of different specific gravities by means of a liquid medium comprising rotatable means defining a frustro-conical separation chamber having a lighter solid outlet at one end and a heavier solid outlet at the other end; a generally fan-shaped wall normal to the axis of rotation stationarily mounted in the chamber dividing a lower portion of the chamber generally into a lighter solid zone and a heavier solid zone, the wall having a substantially arcuate lower surface complementary with, and adjacent, the surface of the chamber; means for supplying mixed solids and liquid medium to the chamber; a vertical opening in the lower arcuate surface of the wall for passage of solids through the wall; and means for removing solids accumulating in the heavier solid zone.

The opening may divide the wall into two substantially segmental plates extending from the surface of the chamber to a level above the liquid in the chamber, and the wall also may be provided with a flexible seal along the lower edge for minimizing migration of solids between the adjacent edges of the plates and the chamber.

A pair of frustro-conical chambers may be utilized with liquid media of two different specific gravities to separate solids of three different specific gravities.

37 Claims, 10 Drawing Figures

APPARATUS FOR SEPARATING SOLIDS

FIELD OF THE INVENTION

This invention relates to apparatus for liquid-medium separation of minerals. More particularly, this invention relates to systems in which ores or minerals of differing density are separated from one another or from impurities by the float-sink principle.

BACKGROUND OF THE INVENTION

In systems for separation of minerals by use of a heavy liquid medium, which are well-known in the art, a mixture of solid particles of different specific gravities, such as crushed ore or coal with waste constituents, is introduced into a heavy liquid medium having a specific gravity between the specific gravities of the various solid particles to be separated. In general, the solid particles having a specific gravity less than that of the heavy liquid float to the surface, while the solid particles having a specific gravity greater than that of the heavy liquid sink.

The liquid medium itself is normally an aqueous suspension of a finely divided solid such as magnetite, ferrosilicon, hematite, galena, borates, silica, or mixtures of one or more of these with other minerals. However, any liquid medium will suffice if it has the necessary specific gravity properties. Some degree of agitation or turbulence is necessary to maintain a substantially uniform suspension of the liquid media. Rotating drums are often used to supply the necessary agitation.

In many such systems the lighter floating particles of the separable minerals are carried away by allowing the liquid medium to overflow from a rotating mixing or separating chamber. The floating particles may then be separated from the liquid by screening or other well-known techniques.

Many such devices also employ blades or scoops to remove the heavier sunken product from the rotating drum.

Despite the current flow created by liquid overflowing from the separator chamber of such separators, the turbulence caused by the rotation of these devices often causes some lighter solids to be caught by blades or scoops. As a result, these lighter solids are carried out with the heavier material. Fixed parallel division walls such as those disclosed in U.S. Pat. No. 1,559,938 do not provide the solids segregation necessary to solve this problem, particularly in more turbulent overflow separators. As a result, a great many of the lighter particles remain dispersed throughout the rejected heavier product. In the case of coal washing separators, where the lighter product is coal, substantial amounts of usable coal are wasted in the heavier reject from these machines due to the inefficiency of the mechanical separating apparatus.

Another wall structure used in the prior art consisted of a pair of elongated L-shaped walls which were mounted in a rotating drum with the longer sides parallel to the axis of rotation. While this structure somewhat reduced the amount of lighter solids which were removed with the heavier sunken product, the L-shaped wall design created dead spaces within the separation chamber where no separation was accomplished, and thereby substantially reduced the area of contact between the solids and the liquid medium.

Also, during shutdown periods such as evenings or weekends, the fine particulate suspension in the liquid medium tends to sink to the bottom surface of the separator drum or chamber. When the apparatus is started, this builtup magnetite or other material requires several minutes to return completely to suspension in the liquid. With the L-shaped wall design discussed above, the walls often catch or bind on the agglomerated mass of particulate so formed, thereby bending the wall or causing other damage to the structure of the separation apparatus. Any fixed wall or other dividing structure mounted in the interior of the drum must be positioned to avoid such binding or catching.

Most raw mineral products also include a substantial number of so-called "middling" particles which may consist of mixtures of light and heavy minerals or pieces of a desired mineral product with heavier impurities on their surface. The presence of such middlings in the purer material lowers the grade of the product, or in a washing operation, increases the amount of impurities in the clean product. However, the inclusion of these particles in the discarded reject fraction results in a substantial economic loss and a higher imperfection rate for the separation system. Several systems have been proposed by which these middlings can be separated from the purer product and then treated in an additional step to further separate the pure or clean product from other minerals and impurities. For example, U.S. Pat. Nos. 2,795,331 and 3,344,918 describe apparatus for separating solid materials into three products of differing specific gravities by heavy media processes.

Previous systems such as those disclosed in these patents have not been able to achieve consistently superior results in terms of efficiency, however, since substantial amounts of lighter particles are not separated from the heavier products. As discussed above, the use of such systems for coal washing results in the loss of significant percentages of usable coal in the reject fraction.

Retention or residence time of the solids in the separating medium also has a critical influence on the quality and completeness of separation. In particular, increased residence time allows the float product more time to rise to the surface of the heavy medium and move into the overflow current area and away from any blades or other means for removing the sink product from the separation apparatus. Thus, any means by which residence time can be increased without adversely affecting other aspects of the system are desired.

The volume of the separation chamber or contact area is also a critical factor in terms of the amount of raw solids which the system will accommodate in a given amount of time. If this separation chamber contact area can be increased, more product can be processed or the speed of the overall operation can be increased.

Accordingly, it is a primary object of this invention to improve apparatus for separating solids by means of a liquid medium.

It is a further object of the invention to recover a substantially more of the lighter product in separation process.

Yet another object of the invention is to increase the residence time of the solids in the separating apparatus and thereby the quality of separation.

A still further object of the invention is to increase the area of contact of the liquid medium and the solids within the separation apparatus and thereby to accommodate a greater volume of solids.

It is a further object of the invention to substantially reduce the migration of lighter solids toward the portion of the separator where heavier solids are evacuated in the separation apparatus.

Another object of the invention is to provide improved apparatus for liquid media separation of solids into three or more products of different specific gravities having the above expressed objects and advantages.

SUMMARY OF THE INVENTION

To achieve the foregoing objects and in accordance with the purpose of the invention, as embodied and broadly described herein, the apparatus for separating mixed solids of two different specific gravities by means of a liquid medium having a specific gravity between those two specific gravities, or two-product separator, comprises rotatable means defining a frustro-conical separation chamber, having a lighter solid outlet at one end defining the liquid medium level in the chamber and a heavier solid outlet at the other end, and having its least cross section adjacent the lighter solid outlet; transverse wall means stationarily mounted in the separation chamber for dividing a lower portion of the separation chamber generally into a lighter solid zone and a heavier solid zone, the wall means having a substantially arcuate lower surface complementary with and adjacent the surface of the frustro-conical separation chamber, at least the outer ends of the wall means being positioned between the minimum and maximum cross-section of the frustro-conical separation chamber; means for supplying the mixed solids and liquid medium to the chamber, the liquid medium overflowing through the lighter solid outlet; means at least in the arcuate lower surface for passage of solids through the wall means; and means for removing solids accumulating in the heavier solid zone through the heavier solid outlet.

Preferably, the passage means includes a vertical opening.

It is also preferred that the wall means be overall generally fan-shaped and that the vertical opening divide the wall means into two substantially segmental plates.

It is also preferred that each of the plates extends from the surface of the frustro-conical chamber to a level above the liquid in the chamber.

It is also preferred that the edges of each of the plates complementary with the surface of the chamber include a flexible seal for minimizing migration of solids between the adjacent edges of the plates and the chamber.

Preferably, the supply means includes inlet channel means for directing the mixed solids and liquid into the chamber and conduit means for feeding the liquid into the chamber.

It is also preferred that the frustro-conical chamber be coextensive with the periphery of the rotatable means, and that the chamber be formed of the frustrums of two cones joined at a common base.

The apparatus for separating mixed solids of three specific gravities by means of two liquid media each having a specific gravity between two different ones of the three specific gravities, or three-product separator, comprises rotatable means defining first and second frustro-conical individual separation chambers, the first chamber having a first lighter solid outlet at one end defining the liquid medium level in the first chamber and the second chamber having a second lighter solid outlet at one end defining the liquid medium level in the second chamber, each of the chambers having its least cross section adjacent the first and second lighter solid outlets, respectively, the first and second lighter solid outlets being at opposite ends of the rotatable means; transverse wall means stationarily mounted in each of the separation chambers for dividing a lower portion of each chamber into a lighter solid zone and a heavier solid zone, each of the wall means having a substantially arcuate lower surface complementary with and adjacent the surface of its frustro-conical separation chamber, at least the outer ends of each wall means being positioned between the minimum and maximum cross sections of its frustro-conical separation chamber; means for supplying the mixed solids and one liquid medium having a specific gravity between the specific gravities of the lighter two of the solids into the first separation chamber; means for supplying a second liquid medium having a specific gravity between the specific gravities of the heavier two of the solids into the second separation chamber; means at least in the lower arcuate surfaces for passage of solids through each of the wall means; means for removing solids accumulating in the heavier solid zone of the first separation chamber and depositing them into the second separation chamber; and means for removing solids accumulating in the heavier solid zone of the second separation chamber.

Preferably each of the passage means includes a vertical opening.

It is also preferred that the wall means in each of the chambers be overall generally fan-shaped, and that each of the vertical openings divide the wall means into two substantially segmental plates.

Each of the plates preferably extends from the surface of the respective chamber to a level above the liquid in its chamber.

BRIEF DESCRIPTION OF THE DRAWINGS

The accompanying drawings which are incorporated in and constitute a part of this specification illustrate one embodiment of the invention and, together, with the description, serve to explain the principles of the invention.

Figure 1:
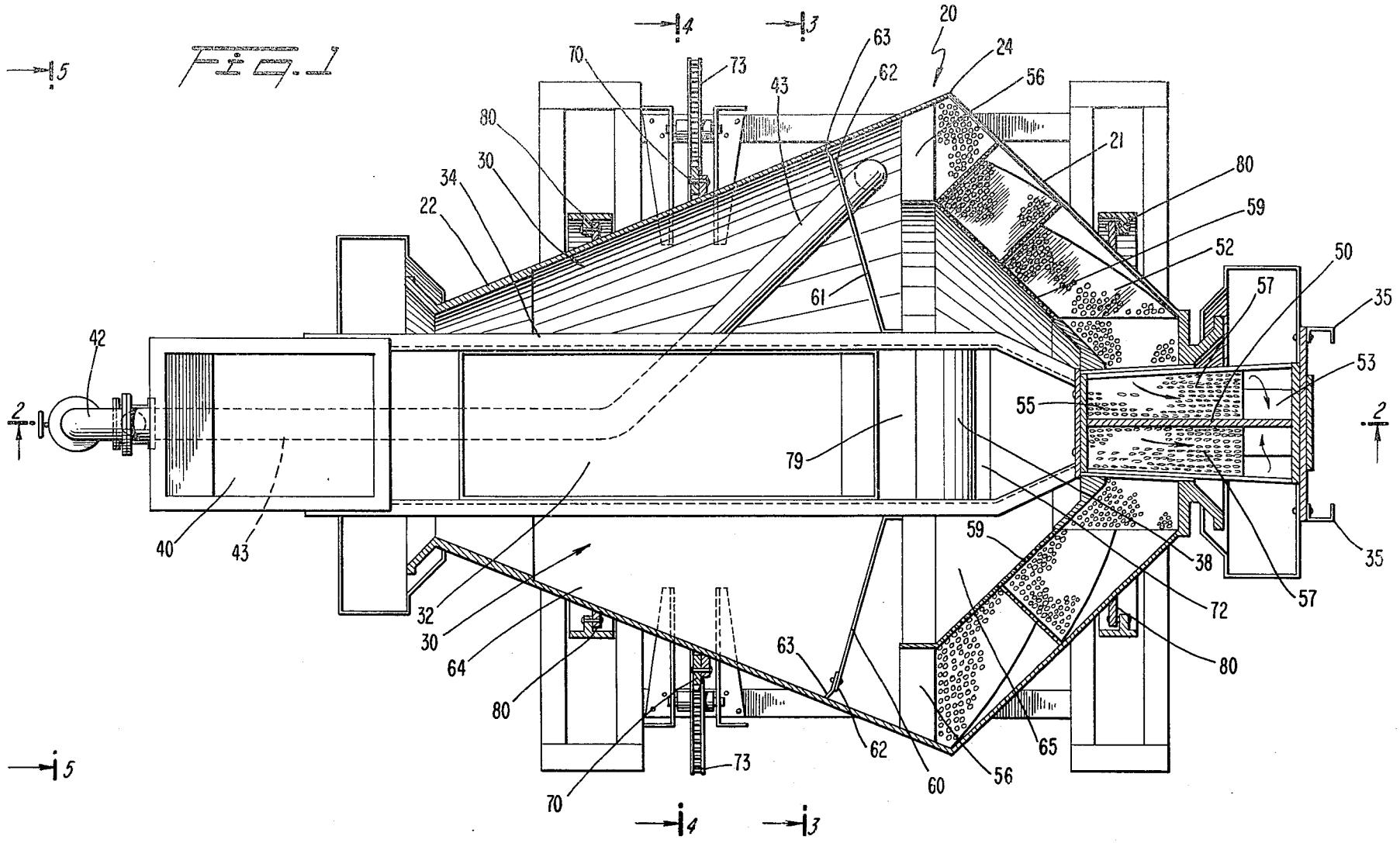
Figure 2:
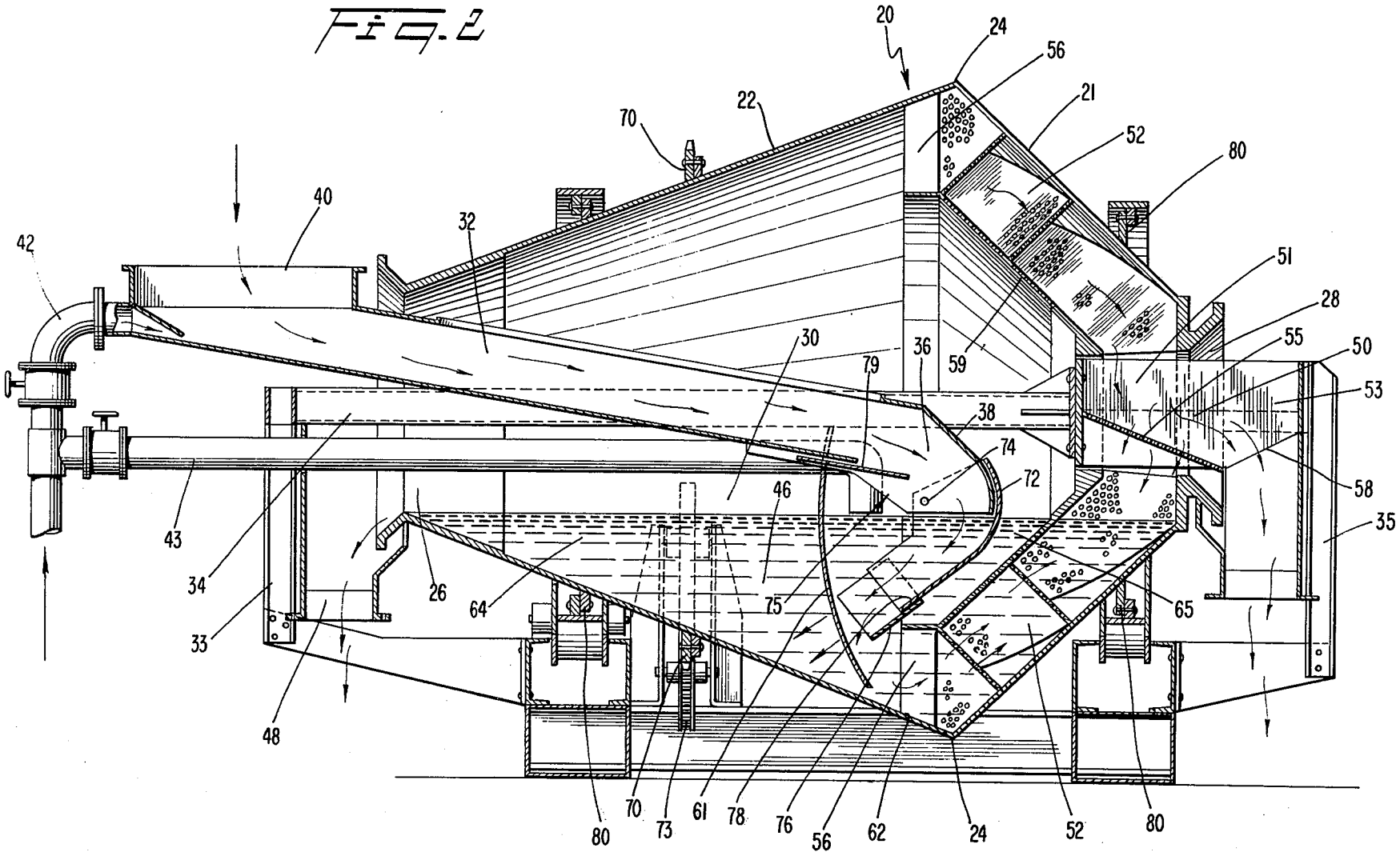
Figure 4:
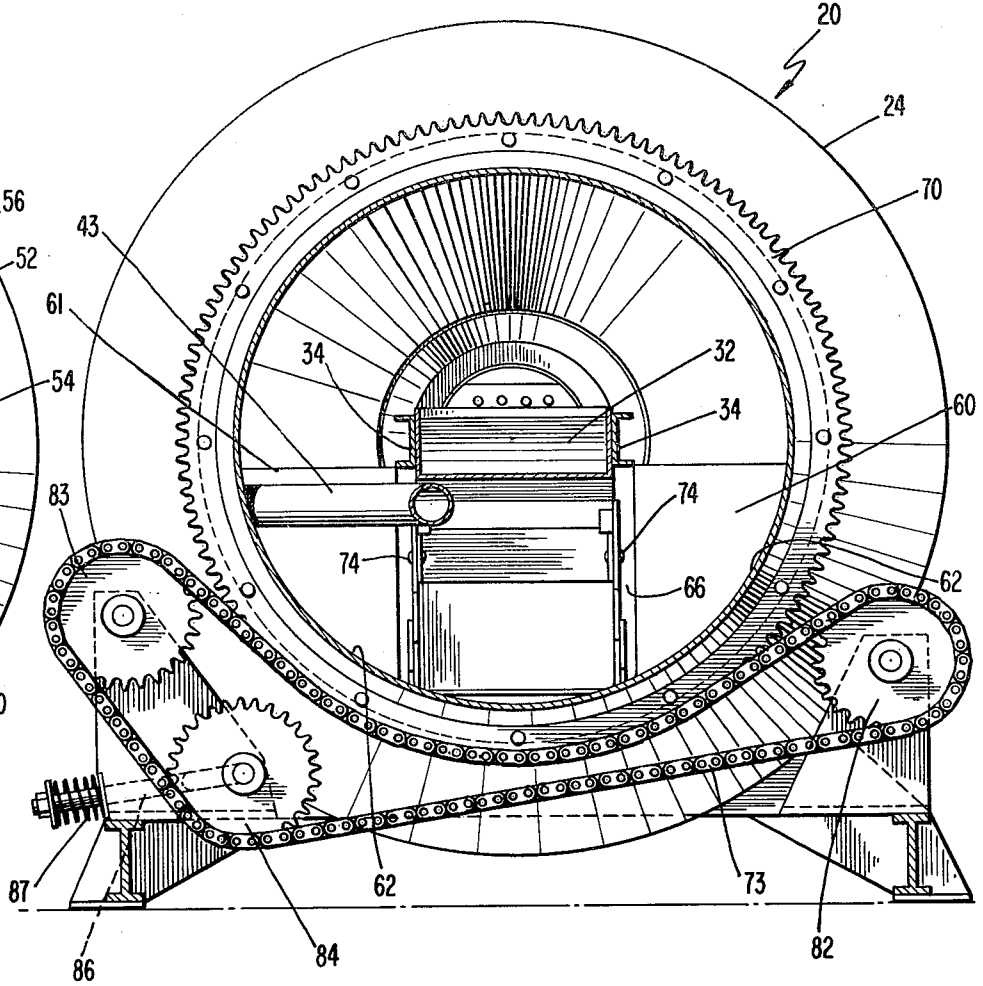
Figure 3:
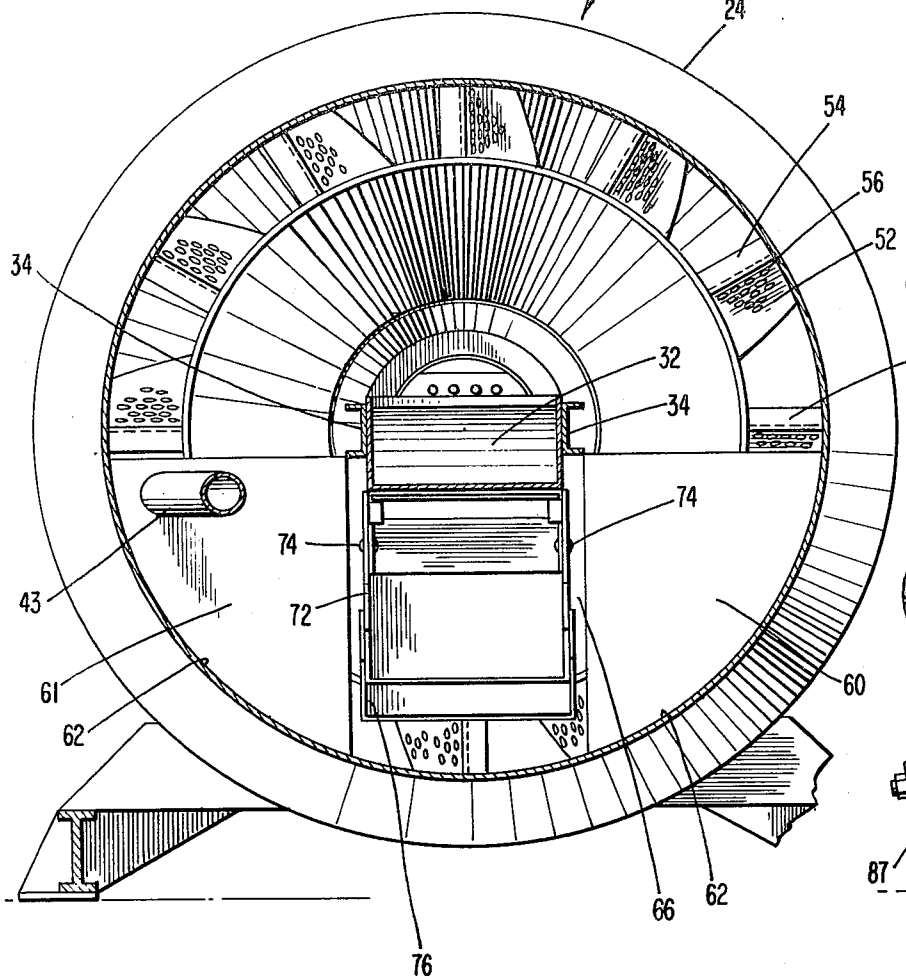
Figure 5:
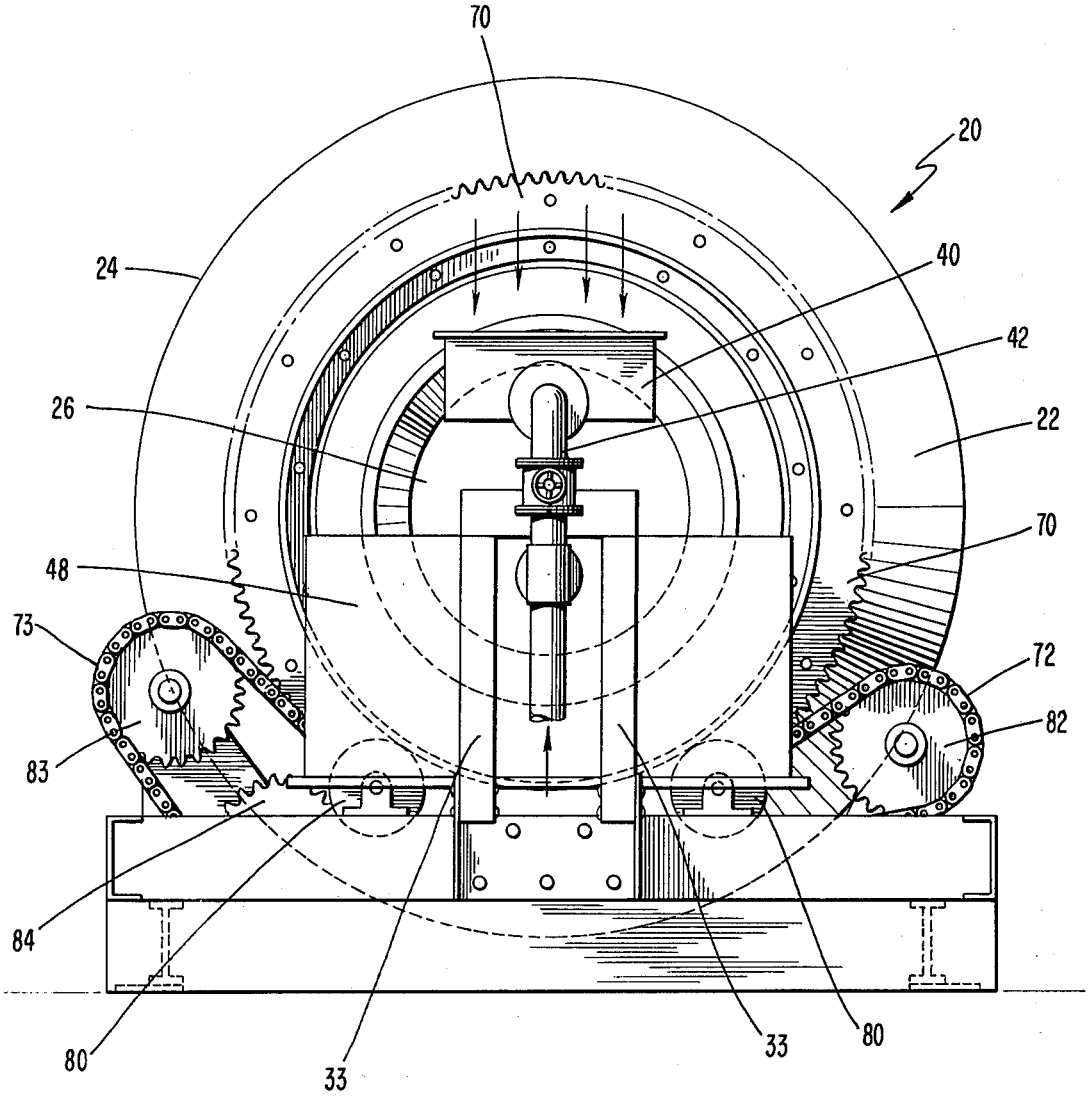
Figure 6:
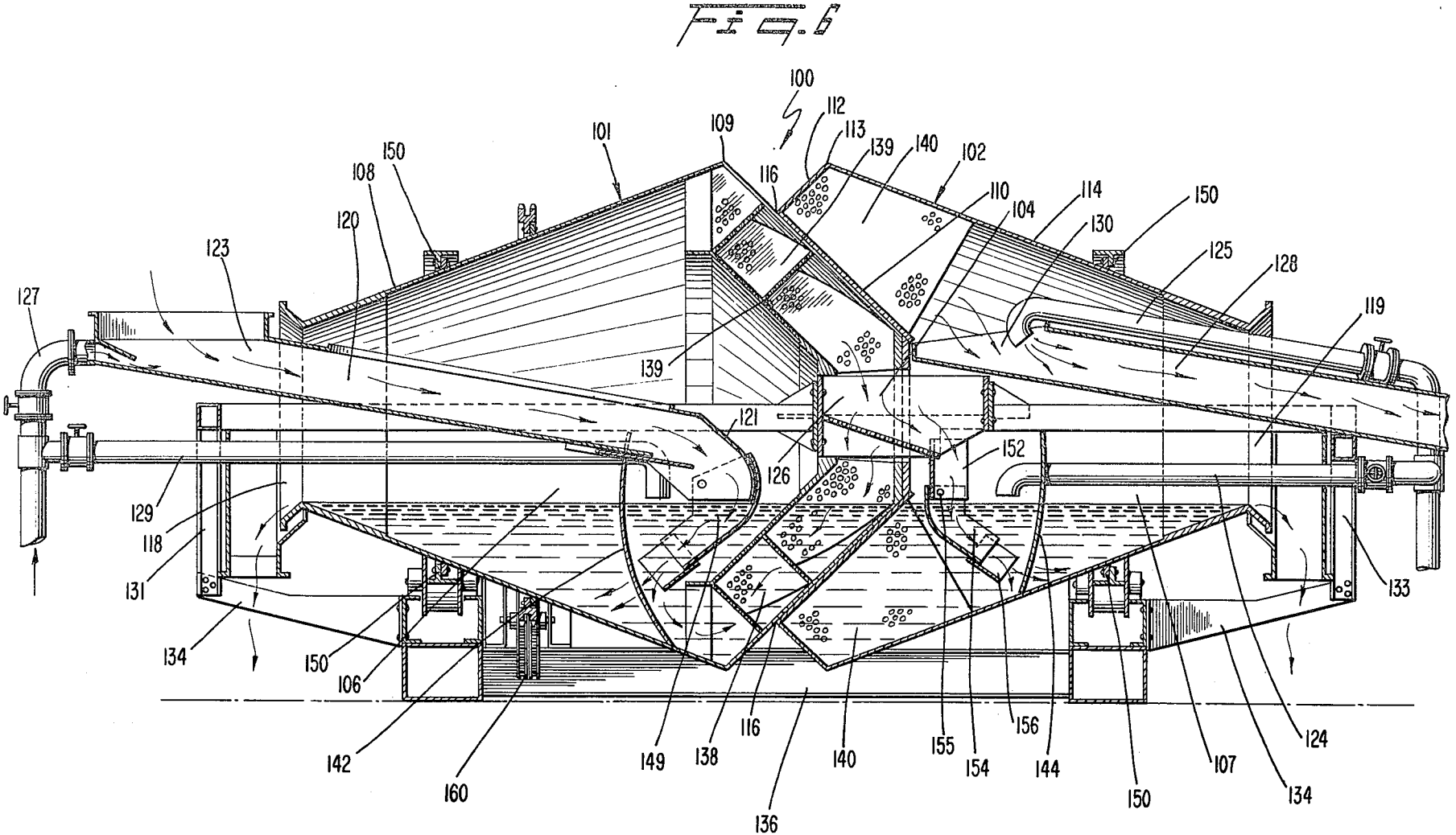
Figure 1:
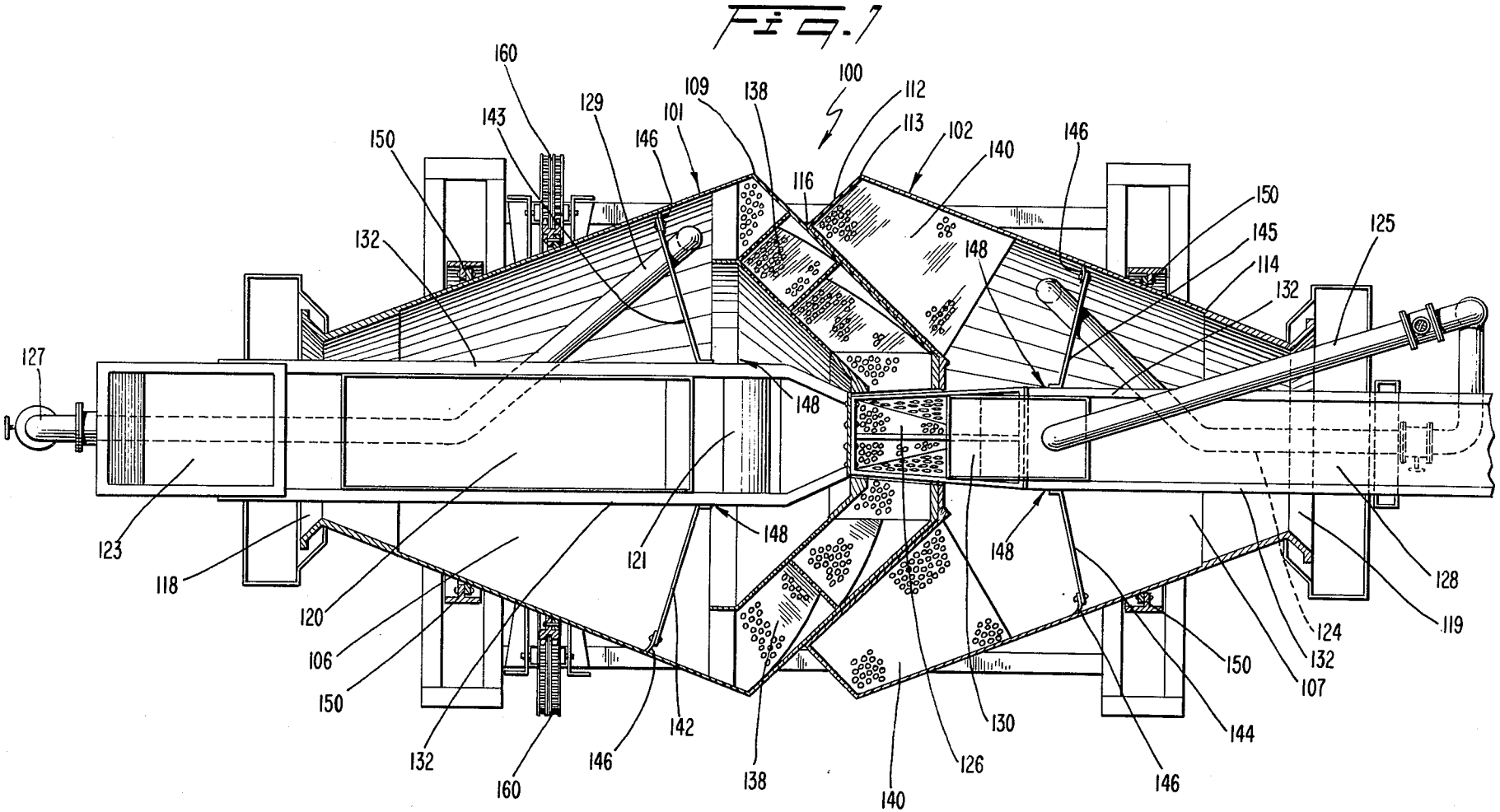
Figure 8:
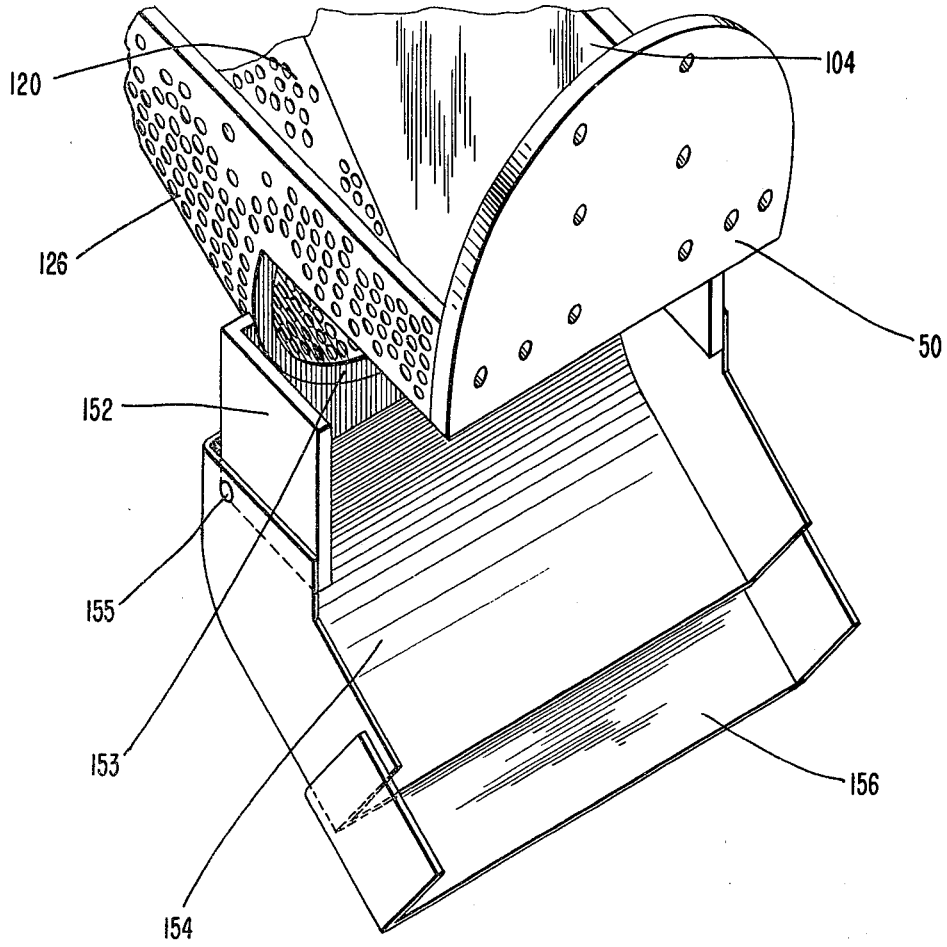
Figure 9:
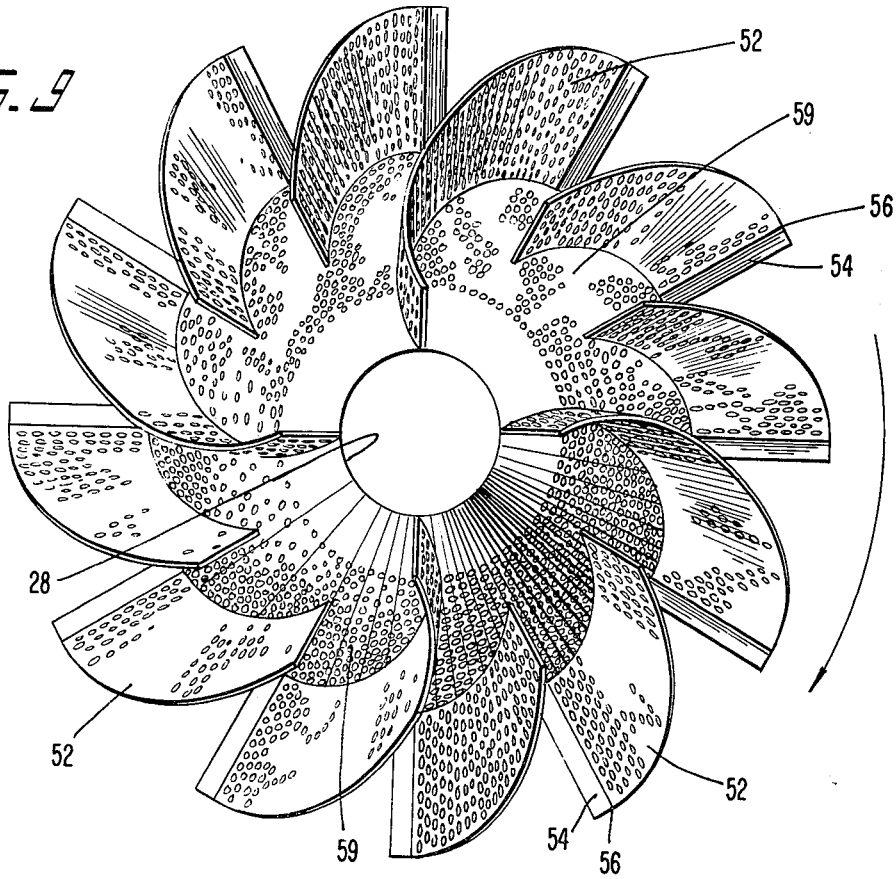
Figure 10:
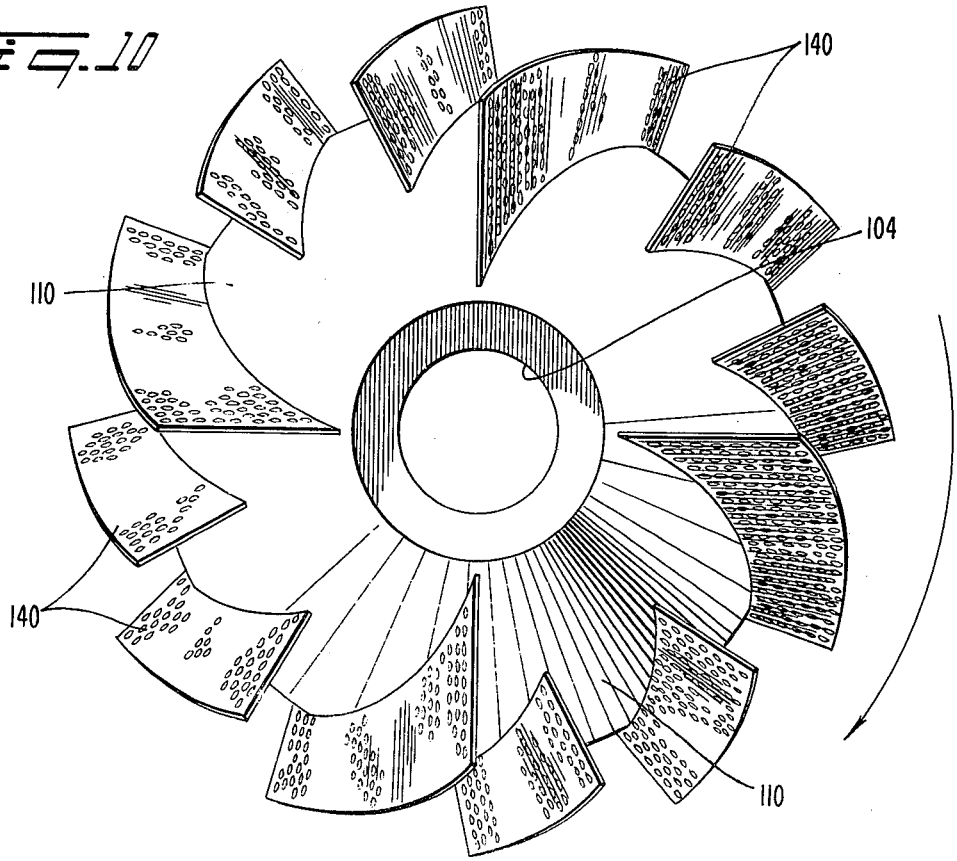

OF THE DRAWINGS:

FIG. 1 is a top plan view of a two-product separator apparatus constructed in accordance with the teachings of this invention;

FIG. 2 is a sectional view taken along line 2—2 of FIG. 1;

FIG. 3 is a sectional view taken along line 3—3 of FIG. 1;

FIG. 4 is a sectional view taken along line 4—4 of FIG. 1;

FIG. 5 is an end view taken along line 5—5 of FIG. 1;

FIG. 6 is a sectional view similar to FIG. 2 of the three-product embodiment of the invention having two separation chambers;

FIG. 7 is a plan view of the embodiment of FIG. 6;

FIG. 8 is a perspective view of the adjustable channel used in the second chamber of the embodiment of FIG. 6;

FIG. 9 is an end view of the blade assembly used in the two-product separator and the first chamber of the three-product separator;

FIG. 10 is a similar end view of the blades in the second chamber of the three-product separator.

DESCRIPTION OF THE PREFERRED EMBODIMENT

Reference will now be made in detail to the present preferred embodiment of the invention, an example of which is illustrated in the accompanying drawings.

The apparatus for separating solids of two different specific gravities, or two-product separator, generally comprises rotatable means defining a frustro-conical separation chamber having a substantially horizontal axis and having a lighter solid outlet at one end defining the liquid level in the chamber and a heavier solid outlet at the other end, and having its least cross section adjacent the lighter solid outlet. The rotatable means, also referred to herein as a drum, may be formed, for example, as a right circular cylinder with the frustro-conical separation chamber mounted within the drum for rotation therewith. Preferably, the frustro-conical chamber is coextensive with the periphery of the drum, and the drum is formed of the frustrums of two cones joined at a common base.

As here embodied and best shown in FIGS. 1 and 2, a rotatable drum, numbered generally as 20, is formed of the frustrums of two cones 21 and 22 joined at a common base 24. The opposite ends of the drum 20 define circular openings 26 and 28. Opening 26 defines the liquid level in the drum 20 and constitutes the lighter solid outlet, while opening 28 is the heavier solid outlet. The internal portion of the drum 20 forms a rotating separation chamber 30, the walls of the chamber being coextensive with the drum. In the illustrated preferred embodiments, cone 21 preferably has a shorter cone height than cone 22; therefore the curved surface of cone 21 meets the common base 24 at a different angle than the curved surface of cone 22.

In accordance with the invention, transverse wall means are stationarily mounted in the separation chamber for dividing a lower portion of the separation chamber generally into a lighter solid zone and a heavier solid zone. The wall means has a substantially arcuate lower surface complementary with, and adjacent the surface of the frustro-conical separation chamber, and at least the outer ends of the wall means are positioned between the minimum and maximum cross section of the frustro-conical separation chamber. The heavier solid zone is on the side of the wall means where the heavier solid outlet is located, and the lighter solid zone is the side of the wall means where the lighter solid opening is located.

As embodied herein, the wall means is overall generally fan-shaped and includes two plates 60 and 61, as shown in FIG. 3, dividing the chamber 30 into a floating solid zone 64 and a heavier solid zone 65. The lower arcuate edges 62 of each of the plates 60 and 61, respectively, abut the circumference of the chamber 30 on the internal surface of cone 22. Preferably, each of the plates 60 and 61 extends from the inner surface of cone 22 to a level above the liquid in the drum. It is also preferred that the edges 62 of plates 60 and 61 which are complementary with the surface of the chamber, include a flexible seal 63 for minimizing migration of solids between the adjacent edges of the plates and the drum.

In accordance with the invention, means are provided at least in the lower arcuate surface of the wall means for passage of solids therethrough. Preferably, the passage means includes a vertical opening which may divide the wall means into the two substantially segmental plates 60 and 61. The plates 60 and 61 may be overall generally fan-shaped. As here embodied, the passage means includes vertical opening 66 as shown in FIG. 3. The opening 66 preferably extends from the lower arcuate surface of the chamber 30 to a level above the liquid in the drum 20, and is wide enough to allow the adjustable extension 70 of the inlet channel 32 (described below) to pass through. The width of the opening 66 allows the channel extension 70 to be rotated upward through and beyond the wall plates 60 and 61 toward the lighter solid outlet 26, and well into the lighter solid zone 64. Therefore, mixed solids can be deposited farther into the lighter solid zone 64 to increase the residence time and allow more complete separation. Heavier solids which sink in the lighter solid zone 64 are carried by gravity along the surface of cone 22 to pass through opening 66 into the heavier solid zone.

The transverse wall plates 60 and 61 of the present invention result in a significant improvement in the efficiency of separation of lighter solids, more complete separation, and a lower imperfection rate.

As best shown in FIG. 3, the plates 60 and 61 are spaced apart by a distance slightly greater than the width of the inlet channel 32. This structure in conjunction with the channel 32 and the channel extension 70, described in detail below, allows the incoming solids to be deposited into the lighter solid zone 64. The orientation and location of the wall plates 60, 61 helps prevent lighter solids from passing into the heavier solid zone 65. Thus, the wall plates 60 and 61 help to maximize the amount of lighter solids which are carried to the lighter solid outlet 26 while minimizing the migration of such floating solids into the heavier solid zone 65 where they might be caught by the rotating blades 52 (described hereinafter). The flexible seal on the lower arcuate surfaces of the wall plates 60 and 61 may be formed of rubber or any other suitable material having the necessary strength and wear resistance.

In addition, the orientation of the walls 60 and 61 generally transverse to the axis of rotation of the drum greatly reduces the possibility that these walls could be damaged on start-up of the separator by agglomerated deposits of magnetite or other material. The flexible seals 63 on the edges 62 and walls 60 and 61 abut the surface of cone 22 in a nearly perpendicular fashion, thus eliminating the likelihood that the stationary walls could bind against such a deposit on the rotating cone 22.

Also, the transverse wall orientation allows for a maximum contact area in which the solids can interact with the liquid medium to accomplish the separation. The improved wall design of the present invention makes use of substantially all of the separation chamber area, thereby increasing the volume of solids which can be separated in a drum of a given size. Likewise, the elimination of dead space in the separation chamber of the present invention also increases the contact area of the solids in the liquid medium. This results in a significant improvement in the quality of separation, greater efficiency, and less loss of lighter solids in the heavier solids fraction.

Means are also provided for supplying mixed solids and liquid medium into the separation chamber. Preferably, the supply means includes an inlet channel for directing the solids and liquid into the drum chamber 30. As here embodied, the inlet channel comprises an open channel 32 passing through the lighter solid outlet 26 in the end of cone 22. The channel 32 is stationarily mounted in the drum 20, as discussed below. Channel 32 is slanted downwardly within the chamber 30 to allow for gravity flow of the solids and the liquid medium into the drum 20. The lower end 36 of the channel 32 is curved downwardly to direct the flow of solids and liquid medium into the central portion of the chamber 30. The curved portion 36 of the channel 32 has a cover plate 38 which guides the solids and liquid medium to the intended deposit area of the separator. Therefore, at least the portion 36 of the channel 32 forms an enclosed channel. In addition, the channel 32 preferably includes a hopper 40 at the upper end thereof for receiving the solids to be separated.

Preferably, the inlet channel 32 is provided with adjustable channel means for varying the specific point of entry of mixed solids into the separation chamber. As here embodied, the adjustable channel means includes an adjustable channel extension 70 having a portion 72 which overlaps the cover plate 38 of the lower curved portion 36. The extension 70 is pivotably mounted to channel 32 at pivot 74. This extension 70 may be pivoted manually through a mechanical linkage (not shown) which operates either inside or externally of the drum 20, or it may be adjusted automatically, for example, by using an internally mounted electric motor or pneumatic control (not shown). Additionally, the extension may be adjusted automatically in response to changes in liquid density. Altering the entry point of the solids into the lighter or heavier zones 64 and 65 can significantly vary the residence and contact times allowing a more efficient and complete separation to be achieved at an optimum point of adjustment. In this manner, the separation process can be optimized for solids and combinations of solids having different characteristics. The use of suitable pivoting connections and mechanisms is well within the skill of the art, given the structure disclosed herein.

As here embodied, the adjustable channel means also includes a telescoping channel end 76 slidably mounted on the lower end 78 of the extension 70. The telescoping end 76 overlaps the lower end 78 of extension 70 on both the sides and bottom to prevent solids from being caught between these members. This telescoping end 76 allows further critical adjustment in the entry point of the solids. The entire adjustable channel structure and particularly the telescoping end 76 works in cooperation with the wall means described previously, to significantly reduce the amount of lighter floating solids which are caught and removed with the heavier solid fraction.

As here embodied, the adjustable channel means also includes a sliding floor plate 79 which is extendable at least to the pivot 76 of the channel extension 70. When the sliding floor plate 79 is utilized, the bottom of the lower end 36 of channel 32 is provided with an opening 75 which allows incoming solids to fall directly into the channel extension 70, or the telescoping end 76. The floor plate 79 can be completely opened, allowing the entering solids to partially bypass the curved portion 36 of channel 32, or it may be closed to divert all entering solids through the extension 70.

The precise adjustment of the plate 79 as well as the extension 70 and the telescoping end 76 will depend upon the specific gravity properties of the particular solids being separated and the liquid medium, and other factors such as the volume of solids being processed, the nature of any impurities in the ore or mineral mixtures, the size of the separation chamber, and the desired speed of the separation process.

As discussed with respect to the channel extension 70, the necessary connections or other mechanisms to provide for manual or automatic adjustment of the telescopic end 76 or the floor plate 79 are within the knowledge and capability of those skilled in the art.

The adjustable channel means described above may be used in any liquid medium separating apparatus in which it might be advantageous to vary the entry point of solids in the separation chamber.

When magnetite is utilized as the finely divided solid suspended in the liquid medium, additional problems may be encountered. Commercially available magnetite often is not demagnetized, and frequently it becomes necessary to add magnetite to the separation system to control the specific gravity of the liquid medium. Although the system may include a demagnetizer which is used in conjunction with a magnetic separator for recovering magnetite from the liquid medium, the newly added magnetite normally must circulate in suspension through several separation cycles before it reaches the demagnetizer.

Before it can be demagnetized, however, some of this newly added magnetite may be magnetically attracted to the metal portions of the drum, particularly the area of the inlet channel which lies below the liquid level.

This can cause a blockage of a portion of the inlet channel, and corresponding decrease in the speed and volume of solids and liquid flowing into the separator.

This problem becomes particularly troublesome when magnetite is added to the system shortly before overnight shutdown of the separator or prior to a weekend, when the separator may not be operated for two consecutive days. The lowest part of the inlet channel can become clogged with magnetite which settles in the chamber when the separator is shut down.

The adjustable channel means of the present invention solves this problem by allowing the portion of the inlet channel below the liquid level to be rotated upward toward the lighter solid outlet 26 between the plates 60 and 61 of the wall during shutdown periods to a position near the surface of the liquid medium. This greatly reduces the chances of blockage caused by magnetite accumulation in the open inlet channel by largely removing the channel from the path of the settling magnetite.

Preferably the supply means also includes conduit means for feeding liquid to the inlet channel. As there embodied, the conduit means comprises a conduit 42 connected to the upper end of the inlet channel 32 and a conduit 43 which feeds liquid directly into the central part of the chamber 30. The liquid medium flowing from conduit 42 into the inlet channel 32 assists in carrying the solids down the inclined inlet channel and into the central portion of the separation chamber 30. As shown in FIG. 2, the liquid 46 fills the lower portion of the rotating chamber 30. The lighter solid outlet 26 is preferably larger than the heavier solid outlet 28 in the opposite end of the separator, therefore the liquid 46 does not overflow from outlet 28 when the lower portion of the chamber is filled to capacity. Alternatively, the heavier solid outlet 28 may be provided with a seal plate (not shown) extending above the fluid line to prevent overflow from that end.

Some of the solids which enter the separation chamber through the inlet channel 32 have a lower density than the liquid medium. Therefore, these solids rise to the top of the liquid medium and are generally carried toward the lighter solid outlet 26 by the current created by the overflowing liquid medium and the rotation of the drum 20. The liquid 46 which overflows through outlet 26 with floating solids is carried through a tube 48 to a series of screens or other suitable structure (not shown) for separating the floating solids from the liquid medium. Control of the migration of floating solids toward the overflow end is a critical factor in improving the efficiency of the separating process.

To reduce wear on the lighter solid outlet 26 caused by the overflowing solid/liquid mixture, the outlet 26 may be lined with a wear-resistant coating, or may be thickened at the overflow point.

Means are also provided for removing solids accumulating in the heavier solid zone through the heavier solid outlet. Preferably, the means for removing heavier solids includes a discharge chute stationarily mounted in the drum for receiving and carrying away the heavier solids from the drum, and a plurality of perforated blades mounted in the heavier solid zone of the drum for rotation therewith. The blades generally lift and deposit the heavier solids into the discharge chute.

As here embodied, the discharge chute comprises a discharge chute 50 mounted in the heavier solid outlet 28 of cone 21.

The chute 50 generally includes a receiving end 51 and a discharge end 53, the receiving end being preferably situated inside the heavier solid outlet 28 of drum 20. The bottom 55 of the chute 50 is slanted downwardly, and the sides 57 are curved downwardly toward the bottom 55 to funnel heavier solids to the discharge end 53. The chute 50 is stationarily mounted on support means described hereinafter to remain fixed with relation to the rotating drum 20.

As embodied herein, a plurality of blades 52 are symmetrically mounted on the internal surface of cone 21. A portion 56 of each blade extends beyond the common base 24 of cones 21 and 22. As shown in FIG. 3, a section 54 on each blade extends perpendicularly to the portion 56. The section 54 together with the remainder of each blade 52 acts as a scoop to retain and lift heavier solids from the surface of the separator as the blades rotate upward with the drum 20. In addition, as shown in FIG. 9, as well as FIGS. 1 & 2, a perforated frustrum 59 encloses the space between the blades 52 trapping the heavier solids in the blade area. The frustrum 59 keeps the solids which fall from the blades 52 from returning to the bottom of the drum 20. The blades 52 are preferably helical in shape, and every third blade may, for example, be elongated to extend to the heavier solid outlet 28 as shown in FIG. 9. When the blades 52 pass the horizontal position, gravity causes these heavier solids to fall in the direction of the discharge chute 50. Those solids which are not directed into the discharge chute 50 fall to adjacent blades where they are again lifted. The blades 52 and the frustrum 59 are perforated to allow the liquid medium to pass through while retaining the solid material. The solids which pass through the lower end 58 of discharge chute 50 are directed to screens or other suitable apparatus for recovering any liquid medium retained thereon.

Preferably, the rotatable drum means also includes support means passing through the drum for stationarily supporting the walls 60 and 61 and the discharge chute 50 with respect to the rotatable drum 20. As embodied herein, the support means includes a structural framework of channel members 33, 34 and 35 which support the internal stationary components of the separator. Members 33 and 35 are vertical, while members 34 pass horizontally through the outlets 26 and 28 of the drum 20. Vertical members 33, 35 may be anchored by any convenient means to the foundation provided for the drum 20. The discharge chute 50 may also form a part of this structural framework between the members 33 and 35 as shown in FIG. 2, or the chute 50 may be mounted directly on the members 34, with those members extending to join the members 35 outside the drum 20.

The rotatable drum means also includes a drive assembly for rotating the drum. As embodied herein and as best shown in FIG. 4, the drive assembly includes a toothed gear 71 mounted about the drum 20 and a drive chain 73 which meshes with the gear 71. Any suitable means may be used to provide the driving force for the chain. The chain 71 is mounted about a driving wheel 82, a driven wheel 83, and an idler wheel 84. The idler wheel 84, which may be either smooth or toothed, is attached to a tension fastener 86 which exerts a constant tension on the wheel 84 and the chain 71. A coiled spring 87 allows the fastener 86 to adjust the tension on wheel 84 and chain 71 during periods when the chain may be overloaded. This often occurs on start-up, or when the separator comes to an abrupt halt due to power failure, etc. The fastener 86 may be connected to an automatic shut-off control (not shown) which is activated by a predetermined excessive tension on the chain 71. This may prevent damage to the separator parts or motor caused by the disengagement of the chain. The drum 20 is rotatably mounted on roller bearings 80 (FIG. 5).

In a typical separating operation a mixture of solids of different specific gravities is fed into hopper 40 and is carried down inlet channel 32 by gravity and by a constant flow of liquid medium from conduit 42. The solids and liquid medium are deposited into the separation chamber through the opening 66 between wall plates 60 and 61, preferably well into the lighter solid zone. The rotation of the drum 20 causes a mixing action which frees the lighter solid particles allowing them to float in the liquid medium 46. The heavier solid particles sink to the surface of the drum 20 and are carried by gravity and the rotational movement to the lower portion of the drum 20. The conical shape of the drum 20 combined with the rotation of the drum impart a helicoidal movement to these heavier solid particles.

The current flow created by the overflowing liquid medium 46 also assists in carrying any lighter solids which may be in the heavier solid zone through opening 66 in the wall plates 61, 62 into the floating solid zone and toward the lighter solid outlet 26. These lighter solids are carried with the overflow through lighter solid outlet 26 of the drum 20 and are then separated from the liquid medium by processes well-known to those skilled in the art.

The heavier solids which slide gradually downward through opening 66 in wall plates 60, 61 toward the common base 24 of cones 21 and 22, are caught by the rotating blades 52 and are carried upward and then deposited in the discharge chute 50 by gravity. These heavier solids are then carried to additional apparatus (not shown) where they are separated from any remaining liquid medium.

The specific gravity of the liquid medium must be controlled within a range between the solids to be separated. This may be accomplished either manually by periodically measuring the specific gravity and adding additional water or fines, or it may be done automatically using suitable control and monitoring apparatus. In addition, systems are available for returning recovered liquid medium to the separating apparatus for reuse.

This invention also includes apparatus for separating solids of three different specific gravities or three-product separator which is similar to the two-product separator described above, however, the three-product separator includes two individual frustro-conical separation chambers. As illustrated in FIGS. 6 and 7, the three-product separator generally comprises rotatable means defining first and second frustro-conical individual separation chambers 106 and 107. The chamber 106 has a first lighter solid outlet 118 at one end defining the liquid medium level in chamber 106 and chamber 107 has a second lighter solid outlet 119 at one end defining the liquid medium level in chamber 107. Each of the chambers has its least cross section adjacent the first and second lighter solids outlets 118 and 119, respectively. Chamber 106 is located in a first portion 101 of the rotatable means or drum 100 and chamber 107 in a second portion 102.

As here embodied, each frustro-conical separation chamber is formed of the frustrums of two cones joined at a common base. The first individual separation chamber 106 is formed of the frustrums of cones 108 and 110 joined at a common base 109, and the second chamber 107 is formed from frustrums 112 and 114 joined at common base 113. Cone 112 is truncated to overlap cone 110 of drum portion 101 and is fixed to cone 110 at a joint 116. Thus, the two conical portions 101 and 102 form a single integral rotating separation apparatus 100. The first portion 101 of drum 100 has a heavier solid outlet 104 at the opposite end from outlet 118 which provide material flow communication from chamber 106 to chamber 107.

In accordance with the invention, transverse wall means are stationarily mounted in each separation chamber of the drum 100. The wall means divide a lower portion of each separation chamber generally into a lighter solid zone and a heavier solid zone and have a substantially arcuate lower surface complementary with and adjacent the surface of its frustro-conical separation chamber. At least the outer ends of each wall means are positioned between the minimum and maximum cross sections of its frustro-conical separation chamber. As embodied herein, the transverse wall means of each chamber include a pair of substantially segmental plates similar to the plates 60 and 61 in FIG. 2. As illustrated in FIG. 7, plates 142 and 143 form the wall in the chamber 106 and plates 144 and 145 in chamber 107. The arcuate lower surfaces 146 of each of the plates abut the drum 100. Each of the plates also extends from the surface of the drum 100 to a level above the liquid in the drum. Preferably, the edges of the plates adjacent the drum 100 include a flexible seal 146 for minimizing migration of solids between the adjacent edges of the plates and the drum. It is also preferred that the flexible seal be formed of rubber; however, numerous other materials known to those skilled in the art would be suitable. The wall plates 144, 145 in separation chamber 107 are substantially similar to the plates 142, 143 in separation chamber 106 although they are formed in a reverse orientation. All of the plates 142, 143, 144, 145 may be overall generally fan-shaped.

In accordance with the invention, means are also provided at least in the lower arcuate surfaces for passage of solids through each of the wall means. As here embodied, the passage means includes a vertical opening 148 in each wall means, similar to the opening 61 in FIG. 3. Preferably, each of these openings extends from the surface of its respective chamber to a level above the liquid in the chamber. The openings in both walls are preferably wide enough to allow the channel extensions 149, 154 on the inlet channel 102 and internal chute 126, described in detail below, to pass through.

In accordance with the invention, means are provided for supplying mixed solids and one liquid having a specific gravity between the specific gravities of two of the solids into the first separation chamber. Preferably, the supply means includes an inlet channel for directing mixed solids and liquid into the first separation chamber. As embodied herein, the inlet channel 120 is stationarily mounted in the portion 101 of drum 100. The channel 120 slants downwardly and has a curved portion 121 at the lower end thereof, and a hopper 123 at the upper end. As in the case of the two-product separator, adjustable channel means, indicated generally by numeral 149, as previously disclosed and as shown in FIG. 6, may be employed in combination with the inlet channel 120 for directing the flow of solids to a particular point in the separation chamber to optimize the separation process.

Preferably, the supply means also includes conduit means for feeding the one liquid into the inlet channel 120 and the chamber 106. As here embodied, the conduit means shown in FIG. 6 includes a conduit 127 similar to the conduit 42 of FIG. 2, which supplies the one liquid medium into the upper end of the inlet channel 120. A second conduit 128 may also be employed to feed the same liquid directly into the central portion of chamber 106.

In accordance with the invention means are also provided for supplying a second liquid having a specific gravity between the heavier of the first two solids and the third solid into the second separation chamber. As embodied herein, the second liquid supply means includes a conduit 124 which feeds the second liquid medium to the second separation chamber 107. Another conduit 125 may also be included to feed the second liquid into an outlet chute 128 described more fully below.

In accordance with the invention, means are provided for removing solids accumulating in the heavier solid zone of the first separation chamber and depositing them into the second separation chamber. Preferably, this solids removal and depositing means includes an internal chute 126 stationarily mounted in outlet 104 of the drum 100 for receiving the heavier solids from the first separation chamber 106 and supplying them to the second separation chamber 107. As embodied herein, the internal chute 126 is similar to the discharge chute 50 of FIG. 2. The chute 126 feeds the heavier solids from the first separating chamber 106 into the second chamber 107 where these solids undergo a second separation in a liquid medium having a different specific gravity from that of the first chamber 106.

In accordance with the invention, the internal chute 126 may be provided with internal adjustable means similar to the structure described above for use in conjunction with inlet channel 32 of FIG. 2. As embodied herein, and as shown in FIG. 8, the internal adjustable means includes a guide plate 152 attached to the lower curved end 153 of the internal chute 126. A curved chute extension 154 is pivoted in the guide plate 152 at two pivot points 155. The extension 154 overlaps the guide plate 152 to prevent spillage of solids into the chamber 107 except in the predetermined location for deposit preferably in the lighter solid zone of the chamber 107.

A lower telescoping member 156 is slidably mounted to the extension 154 to provide further control over the precise point of entry of solids into the chamber 107. As described above, various improvements in the separation process are realized through the use of this structure in cooperation with the wall means of this invention. Thus, the solids from the first separation chamber 106 may be deposited into the lighter solid zone of the second chamber 107 in a position which minimizes the amount of lighter solids which float through the vertical opening between the wall plates 144, 145 into the heavier solid zone. All of the advantages described previously with respect to the structure of the wall means in the two-product separator are also achieved in each chamber of the three-product separator.

Preferably, the means for removing solids accumulating in the heavier solid zone of the first chamber and depositing them into the second chamber also includes a plurality of perforated blades mounted in the first chamber for rotation with the drum and for lifting and depositing the heavier solids from the first chamber into the internal chute. As embodied herein, a plurality of blades 138 are arranged in the same configuration as the blades 52 in FIG. 2. The blades 138 are symmetrically mounted on the inner surface of the portion 101 of drum 100 and rotate therewith. The perforations are sized to allow only the liquid medium to pass through. Solids from the first chamber 106 which are lifted by blades 138 and deposited into the internal chute 126 enter the second chamber 107 as described above. As shown in FIG. 9, the blades are generally helical in shape, and every third blade is elongated to reach the opening 104. A perforated frustrum 139 similar to frustrum 59 in the two-product separator encloses the space between the blades 138.

In accordance with the invention, means are also provided for removing solids accumulating in the heavier solid zone of the second separation chamber. Preferably that means includes an outlet chute stationarily mounted in the drum for receiving and carrying away the heavier solids from the second separation chamber. As embodied herein, the outlet chute includes an elongated channel 128, shown in FIG. 7, passing through the second lighter solid outlet 119 in the cone 102. The upper end 130 of the chute 128 forms a hopper for receiving the heavier solids from the second separation chamber 107. As with the two product separator, the heavier solids from the discharge of the three product separator are further processed to recover liquid and magnetite or other fines from the surface of the heavier solids.

The outlet chute 128 for discharging heavier solids from chamber 107 may be an open channel similar to the inlet channel 120, or it may be substantially enclosed except for that portion comprising hopper 130. The entire chute 128 is supported by support means described below, which are similar to the support means of the two-product separator.

Preferably, the means for removing solids accumulating in the heavier solid zone of the second separation chamber also includes a plurality of perforated blades 140 mounted in the second chamber for rotation with the drum and for lifting and depositing the heavier solids from the second chamber into the outlet chute. As embodied herein, the perforated blades 140 in the second separation chamber 107 are symmetrically mounted on the inner surface of the portion 102 of the drum 100. The blades 140 are similar to the blades 138, however, due to the truncated structure of cone 112, the blades are formed in the space between the outer surface of cone 110 and the inner surfaces of cones 112 and 114. The blades 140 do not include perpendicular portions corresponding to the sections 54 on blades 52 of the two-product separator as shown in FIG. 3, since the blades 140 direct the flow of heavier solids toward the outlet chute 128, and the downward sloping shape of cone 114 substantially eliminates the need for any scooping action by the blades 140. Also, there is no frustrum similar to frustrum 59 in the two-product apparatus since the surface of cone 110 itself serves the function of frustrum 59 to trap solids in the blade area.

Preferably, the drum means also includes support means passing through the drum for stationarily supporting the wall means, the internal chute and the outlet chute with respect to the rotatable drum. As here embodied, the support means includes a structural framework of channel members, 131, 132 and 133 which support the plates 141, 142, 143 and 144, the internal chute 126, the outlet chute 128 and the inlet chute 120. The members 131 and 133 extend vertically and connect with the opposite ends of member 132. Member 131 and 133 may be joined to a base structure 136 via diagonal members 134, or may be fixed to the base through some other structural frame assembly. The internal chute 126 may be integrated into the supporting framework or the chute 126 may be supported directly on the members 132.

The drum means also includes a drive assembly for rotating the drum 100. As embodied herein, the drive assembly is substantially similar to that of the two-product separator described previously except that a double drive chain is used. Each drive chain 160 meshes with a toothed gear (not shown) to provide the rotational force for the drum. The entire drum is mounted on ball bearing rollers 150 similar to the rollers 80 in FIG. 5. However, the three-product separator is substantially heavier than the two-product separator and therefor the supporting structure must have a greater capacity.

In a typical separating process, mixed solids are fed to the first chamber 106 through the inlet channel 120, the flow of solids being assisted by the introduction of the first liquid medium through conduit 127 directly into the inlet channel 120. The solids enter the chamber 106 preferably in the lighter solid zone where the lighter solids float upward in the liquid and are drawn toward the first lighter solid outlet 118. The heavier solids sink to the surface of cone 108 and are carried downward in a generally helicoidal path by gravity and the rotation of the drum 100, through the opening 148 in wall plates 142, 143, and are caught by blades 138 as they approach the base 109 of cones 108 and 110. The lighter solids are carried out of the first lighter solid outlet 118 by the overflowing liquid and are directed to screens or other means for recovering the solids and liquid. The heavier solids are carried upward by the rotating blades 138 and are deposited into internal chute 126 by gravity. These heavier solids then enter the second separation chamber 107 preferably in the lighter solid zone where the second liquid medium of a different specific gravity has been supplied through conduit 124. In chamber 107 the lighter of the solids from the first chamber 106 rise toward the surface and are drawn by the current of the liquid toward the second lighter solid outlet 119. These lighter solids are carried out of the drum 100 by the second liquid overflowing from outlet 119, after which the solids and liquid are separated by well-known techniques.

The heavier solids from the first chamber 106 sink to the surface of cone 114 and slide downward in a helicoidal path through opening 148 in wall plates 144, 145 toward the blades 140. The rotating blades 140 lift these heavier solids and deposit them into hopper 130 of outlet chute 128. Additional liquid is supplied directly into hopper 130 through conduit 125 to aid the flow of the heavier solids down the inclined outlet chute 128 and out of the drum 100. The chute 128 similarly directs the heavier solids and liquid to additional well-known separating means.

Thus, the three-product separator provides a highly efficient, continuous system for separation of solids while holding overall costs to a minimum, particularly in relation to the raw materials required. The separator may be used for a variety of purposes, including coal washing, mineral separation, and recovery of valuable material from industrial wastes.

As will be understood by those skilled in the art from the above disclosure, a plurality of similar separation chambers may be formed to allow simultaneous separation of four or more products.

It will be apparent to those skilled in the art that various modifications and variations could be made in the structure of the invention without departing from the scope and spirit of the invention.

I claim:

1. Apparatus for separating mixed solids of two different specific gravities by means of a liquid medium having a specific gravity between said two specific gravities, comprising:

rotatable means defining a frustro-conical separation chamber, said chamber having a lighter solid outlet at one end defining the liquid medium level in said chamber and a heavier solid outlet at the other end; and said chamber having its least cross section adjacent said lighter solid outlet;

transverse wall means stationarily mounted in said separation chamber for dividing a lower portion of said separation chamber into a lighter solid zone and a heavier solid zone, said wall means having a substantially arcuate lower surface complementary with, and adjacent, the surface of said frustro-conical separation chamber at least the outer ends of said wall means being positioned between the minimum and maximum cross sections of said frustro-conical separation chamber;

means for supplying the mixed solids and liquid medium to said chamber, said liquid medium overflowing through said lighter solid outlet;

means at least in said arcuate lower surface for passage of solids through said wall means;

means for removing solids accumulating in said heavier solid zone through said heavier solid outlet.

2. The apparatus of claim 1 wherein said passage means includes a vertical opening.

3. The apparatus of claim 2 wherein said wall means is generally fan-shaped, said opening dividing said wall means into two substantially segmental plates.

4. The apparatus of claim 3 wherein each of said plates extends from the surface of said chamber to a level above said liquid in said chamber.

5. The apparatus of claim 4 wherein the edges of each of said plates complementary with the surface of said chamber include a flexible seal for minimizing migration of solids between the adjacent edges of said plates and said chamber.

6. The apparatus of claim 5 wherein said supplying means includes an inlet channel stationarily mounted in the chamber for directing the mixed solids and liquid into the chamber and conduit means for feeding liquid to said chamber.

7. The apparatus of claim 6 wherein said frustro-conical chamber is coextensive with the periphery of said rotatable means.

8. The apparatus of claim 7 wherein said rotatable means is formed of the frustrums of two cones joined at a common base.

9. The apparatus of claim 8 wherein said cones meet in the common base at different angles.

10. The apparatus of claim 9 wherein said means for removing solids includes a discharge chute stationarily mounted in said chamber and a plurality of blades mounted in said chamber for rotation therewith for lifting and depositing the heavier solids into the discharge chute.

11. The apparatus of claim 10 wherein said apparatus also includes support means for stationarily supporting the inlet channel, the wall plates, and the discharge chute with respect to said rotatable means.

12. The apparatus of claim 11 wherein said inlet channel is slanted downwardly into the chamber.

13. The apparatus of claim 12 also including adjustable channel means mounted on the lower end of the inlet channel for controlling the point of entry of the mixed solids into the chamber.

14. The apparatus of claim 13 wherein said adjustable channel means includes a channel extension pivotably mounted in the lower end of said channel.

15. The apparatus of claim 14 wherein said adjustable channel means includes a telescoping end slidably mounted on said channel extension.

16. The apparatus of claim 15 wherein said channel has an opening in the bottom surface thereof, and said adjustable channel means includes a movable plate slidably mounted in the inlet channel over said opening.

17. Apparatus for separating mixed solids of three different specific gravities by means of two liquid media each having a specific gravity between two different ones of said three specific gravities, comprising:

rotatable means defining first and second frustro-conical individual separation chambers, said first chamber having a first lighter solid outlet at one end defining the liquid medium level in said first chamber, and said second chamber having a second lighter solid outlet at one end defining the liquid medium level in said second chamber, each of said chambers having its least cross section adjacent said first and second lighter solid outlets, respectively, said first and second lighter solid outlets being at opposite ends of said rotatable means;

transverse wall means stationarily mounted in each of said separation chambers for dividing a lower portion of each chamber into a lighter solid zone and a heavier solid zone, each of said wall means having a substantially arcuate lower surface complementary with and adjacent the surface of its frustro-conical separation chamber, at least the outer ends of each wall means being positioned between the minimum and maximum cross sections of its frustro-conical chamber;

means for supplying the mixed solids and one liquid medium having a specific gravity between the specific gravities of the lighter two of said solids into said first separation chamber;

means for supplying a second liquid medium having a specific gravity between the heavier of said two solids and the third solid into said second separation chamber;

means at least in said lower arcuate surfaces for passage of solids through each of said wall means;

means for removing solids accumulating in said heavier solid zone of said first separation chamber and depositing them into the said second separation chamber; and means for removing solids accumulating in said heavier solid zone of said second separation chamber.

18. The apparatus of claim 17 wherein each of said passage means includes a vertical opening.

19. The apparatus of claim 18 wherein said wall means in each of said chambers is generally fan-shaped, each of said openings dividing said wall means into two substantially segmental plates.

20. The apparatus of claim 19 wherein each of said plates extends from the circumference of the respective chamber to a level above the liquid in said chamber.

21. The apparatus of claim 20 wherein the edges of the plates complementary with the surface of the respective chamber each includes a flexible seal for minimizing migration of solids between the adjacent edge of the plate and the chamber.

22. The apparatus of claim 21 wherein said flexible seals are formed of rubber.

23. The apparatus of claim 21 wherein the means for supplying mixed solids and one liquid medium includes an inlet channel stationarily mounted in the first chamber for directing the mixed solids and said one liquid into the first chamber, and conduit means for feeding said one liquid to said first chamber.

24. The apparatus of claim 23 wherein each of said frustro-conical separation chambers is formed of the frustrums of two cones joined at a common base.

25. The apparatus of claim 24 wherein said cones meet in the common base at different angles.

26. The apparatus of claim 25 wherein said means for supplying a second liquid medium includes a conduit stationarily mounted in said second chamber for supplying said second liquid into said second chamber.

27. The apparatus of claim 26 wherein said means for removing solids accumulating in said heavier solid zone of said first separation chamber includes an internal chute stationarily mounted between said first and second separation chambers, and a plurality of blades mounted in the heavier solid zone on the inner surface of the first separation chamber for rotation therewith and for lifting and depositing said heavier solids into the internal chute.

28. The apparatus of claim 27 wherein said internal chute includes internal adjustable means for controlling the point of entry of the heavier solids from the first separation chamber into the second separation chamber.

29. The apparatus of claim 28 wherein the internal chute has a lower end, said internal adjustable means including a guide plate attached to said lower end and an overlapping chute extension pivotably mounted on said guide plate.

30. The apparatus of claim 29 wherein said internal adjustable means also includes an overlapping telescoping member slidably mounted on the chute extension.

31. The apparatus of claim 27 wherein said means for removing solids accumulating in said second separation chamber includes an outlet chute stationarily mounted through the second lighter solid outlet and a plurality of blades mounted on the inner surface of the heavier solid zone of said second separation chamber for rotation therewith and for lifting and depositing the heavier solids from the second separation chamber into the outlet chute.

32. The apparatus of claim 31 wherein said means for supplying the second liquid medium also includes a conduit stationarily mounted in the second chamber for supplying said second liquid into the outlet chute.

33. The apparatus of claim 32 wherein said drum means also includes support means for stationarily supporting the inlet channel, the wall plates, the internal chute, the conduits and the outlet chute with respect to said rotating means.

34. In an apparatus for separating solids of two different specific gravities by means of a liquid medium having a specific gravity between said two specific gravities, said apparatus including rotatable means defining a separation chamber, means for supplying mixed solids and liquid to said chamber, said liquid overflowing from said chamber for carrying away lighter solids, and means for removing heavier solids from said chamber; the improvement wherein said supplying means includes adjustable means for varying the point of entry of said solids into said chamber.

35. The apparatus of claim 34 wherein said supplying means includes an inlet channel mounted in said chamber and said adjustable means includes a channel extension pivotably mounted in said channel.

36. The apparatus of claim 35 wherein said adjustable means includes a telescoping end slidably mounted on said channel extension.

37. The apparatus of claim 36 wherein said adjustable means includes a movable plate slidably mounted in the inlet channel over said opening.

* * * * *